US006251255B1

(12) United States Patent
Copping et al.

(10) Patent No.: US 6,251,255 B1
(45) Date of Patent: Jun. 26, 2001

(54) APPARATUS AND METHOD FOR ELECTROPLATING TIN WITH INSOLUBLE ANODES

(75) Inventors: William J. Copping, Youngstown; William Clayton Lekki, North Tonawanda; John Paul Cassoni, Grand Island, all of NY (US)

(73) Assignee: Precision Process Equipment, Inc., Niagara Falls, NY (US)

( * ) Notice: Subject to any disclaimer, the term of this patent is extended or adjusted under 35 U.S.C. 154(b) by 0 days.

(21) Appl. No.: 09/468,473

(22) Filed: Dec. 21, 1999

Related U.S. Application Data

(60) Provisional application No. 60/113,322, filed on Dec. 22, 1998.

(51) Int. Cl.[7] ..... C25D 3/30

(52) U.S. Cl. ..... 205/300; 205/302; 204/237; 204/252; 204/253; 204/257; 204/263; 204/267; 204/269; 204/275.1

(58) Field of Search ..... 205/300, 302; 204/228.1, 232, 237, 252, 253, 257, 263, 267, 269, 275.1

(56) References Cited

U.S. PATENT DOCUMENTS

| | | | | |
|---|---|---|---|---|
| 2,541,721 | * | 2/1951 | Roehl et al. | 205/302 |
| 4,936,965 | * | 6/1990 | Ooniwa et al. | 205/302 |
| 5,312,539 | * | 5/1994 | Thomson | 205/302 |

* cited by examiner

*Primary Examiner*—Bruce F. Bell
(74) *Attorney, Agent, or Firm*—Hodgson Russ LLP

(57) ABSTRACT

An apparatus and process for adding electrolytically dissolved tin to the electrolyte solution of a tin plating cell is described. The tin plating process cell has an insoluble anode. In conventional plating processes, this requires the addition of tin salts to the process cell electrolyte. The tin salts represent a substantial cost, both in term of materials and waste removal. The present plating apparatus includes a secondary cell, separate from the main process plating cell, which has a dedicated rectifier, and in which a soluble tin anode and a cathode are separated by a perm-selective ion exchange membrane. The anode compartment of the secondary cell is hydraulically connected to the process cell and serves to continuously add tin to the plating process, as needed.

16 Claims, 1 Drawing Sheet

APPARATUS AND METHOD FOR ELECTROPLATING TIN WITH INSOLUBLE ANODES

CROSS-REFERENCE TO RELATED APPLICATION

The present application claims priority on provisional application Ser. No. 60/113,322, filed Dec. 22, 1998.

BACKGROUND OF THE INVENTION

1. Field of the Invention

The present invention generally relates to a metal plating process and, in particular, to a novel process and apparatus for plating a workpiece with tin.

2. Prior Art

When insoluble anodes are used in a methane sulfonic acid (MSA) based tin plating process, or other tin electroplating process such as those provided with a tin sulfate or a tin fluoroborate compound, all of the plated tin is derived from the dissolved tin salt. In other words, the tin MSA, tin fluoroborate or tin sulfate is the sole source for the plated tin. The tin compound represents a significant cost to the plating process. Additionally, the acidity of the plating bath builds up over time, necessitating periodic bailouts. After the bailout, tin MSA or the other tin bearing salt and organic additives must be added back into the plating bath. Also, the bailed out solution is a waste product which must be treated. These are all steps in a conventional tin plating procedure which add cost to the final product.

The present invention, as an improvement on the prior art plating process, eliminates, or greatly reduces the need to periodically add a tin salt to the plating bath, and for removing and treating the acid built up in the plating bath.

SUMMARY OF THE INVENTION

According to the present invention, tin in the process cell, which is used up or plated out during the plating operation, is replenished with tin metal from a secondary cell. The secondary cell is hydraulically connected to the process cell. Tin metal costs significantly less, i.e., about 85% less, than tin MSA. Acid bailout and the costs associated with organic additives are eliminated or reduced and, consequently, waste treatment costs are significantly reduced. A further advantage of the present invention is that the plating process operates at a relatively constant concentration of tin and acid.

These and other objects of the present invention will become increasingly more apparent to those skilled in the art by reference to the following description and the appended drawings.

DETAILED DESCRIPTION OF THE INVENTION

Figure 1:
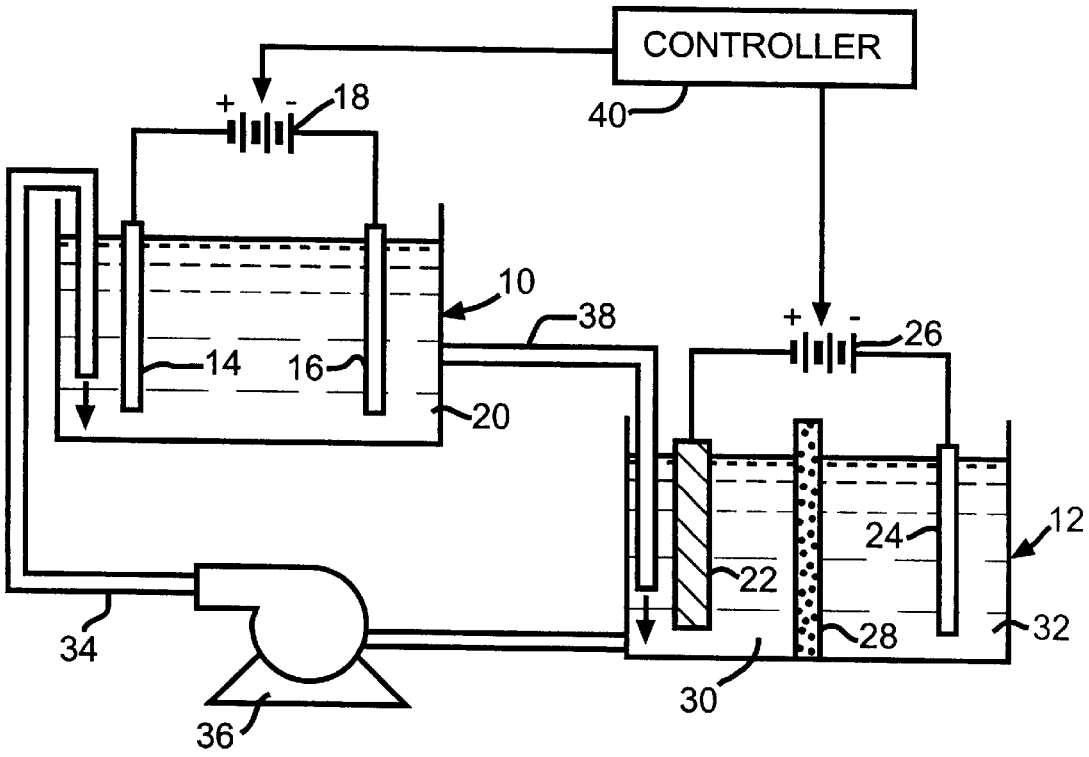
FIG. 1 is schematic representation of the plating process of the present invention.

Turning now to the drawing, FIG. 1 illustrates the process of the present invention including a primary or process, electroplating cell 10 and a secondary cell 12. The process cell comprises an insoluble anode 14 and a cathode workpiece 16 electrically connected to each other by a circuit including a main or process rectifier 18 and an electrolyte bath 20. A preferred material for the insoluble anode is titanium coated with iridium oxide and/or ruthenium oxide, commercially available from Eltech Inc. under the designation DSA. An alternate material for the insoluble anode is platinum plated titanium.

The secondary cell 12 comprises a soluble anode 22 and a tin sheet cathode 24 electrically connected to each other by a circuit including a secondary rectifier 26 and activating electrolyte. Titanium, tin, stainless steel, copper, copper alloys, steel, ferrous alloys and nickel alloys are materials which are also useful for the secondary cathode. The soluble anode 22 and the stainless steel cathode 24 are separated from each other by a permeability-selective (perm-selective) ion exchange membrane 28, which essentially segregates the secondary cell into two compartments, one being the anolyte compartment 30 and the other the catholyte compartment 32. The perm-selective membrane 28 may be of the cationic or anionic type.

The process cell 10 is in fluid flow communication with the secondary cell 12 by a conduit 34 and circulation pump 36 which circulates the electrolyte in the anolyte compartment 30 of the secondary cell 12 to the process cell 10. A second, overflow conduit 38 drains from the process cell 10 to the anolyte compartment 30 of the secondary cell 12.

During the electroplating process of the present invention, oxygen is produced and released at the insoluble anode 14 of the process cell 10, as shown by equation I, and tin, provided by the tin salt in the electrolyte 20, is reduced to tin metal at the cathode workpiece 16, as shown by equation II.

$$H_2O \rightarrow \tfrac{1}{2}O_2 + 2H^+ + 2e \qquad \text{I}$$

$$(CH_3SO_2O)_2Sn + 2H^+ 2e \rightarrow Sn^0 + 2CH_3SO_2OH \qquad \text{II}$$

In the hydraulically connected anolyte compartment 30 of the secondary cell 12, tin is dissolved from the soluble anode 22, thereby replenishing the tin concentration in the anolyte compartment. The anolyte compartment 30 of the secondary cell 12 is in fluid flow communication with the process cell 10. According to the present invention, the electrolyte having the replenished tin concentration from the anolyte compartment is moved to the process cell 10 through conduit 34 by pump 36. The anolyte electrolyte consumes the acid produced at the insoluble anode 14 in the process cell, as shown by equation III. The tin methane sulfonic acid formed in the anolyte compartment 30 of the secondary cell 12 is substantially prevented from flowing into the catholyte compartment 32 by the perm-selective ion exchange membrane 28. In the catholyte compartment 32, water is dissociated producing hydrogen gas and hydroxyl ions, as shown by equation IV.

A perm-selective ion exchange membrane useful with the present invention is a cationic ion exchange membrane which allows only about 10% of the tin dissolved from the anode 22 into the anolyte 30 to migrate to the catholyte compartment 32 to be deposited on the cathode 24, as shown by equation V. A preferred cation exchange membrane is of a perfluorinated ion exchange polymer reinforced with a support cloth of polytetrafluoroethylene. Such membranes are commercially available from DuPont under the NAFION designation. A perfluorinated ion exchange polymer membrane is permeable to cations and polar compounds, but almost completely rejects anions and nonpolar species. Anionic membranes are also useful with the present invention. Therefore, it is contemplated by the scope of the present invention that any cationic or anionic type membrane capable of preventing at least about 90% of the tin produced by the soluble anode from migrating to the secondary cathode is suitable.

$$Sn^0+2CH_3SO_2OH \rightarrow (CH_3SO_2O)_2Sn^++2H^++2e \quad \text{III}$$

$$2H_2O+2e \rightarrow H_2+2OH \quad \text{IV}$$

$$(CH_3SO_2O)_2Sn+2H^++2e \rightarrow Sn^0+2CH_3SO_2OH \quad \text{V}$$

In a conventional tin plating process, using insoluble anodes, the tin concentration in the electrolyte 20 gradually declines as the acid concentration increases, as shown by equation II. The diminished tin must be replaced by adding tin methane sulfonic acid or some other salt such as tin sulfate or tin fluoroborate. Tin methane sulfate is about seven to eight times as expensive as tin metal, based on the tin value. Furthermore, the increasing acid concentration of the electrolyte 20 necessitates a periodic partial bailout of the process cell 10 to reduce acid concentration to a desired level. In addition to there being a cost associated with waste treatment of the removed acid, the bailouts also remove a portion of the organic additives used for grain refinement and brightening of the deposited tin layer.

The plating process of the present invention overcomes the drawbacks inherent in conventional plating processes by replacing at least 90% of the tin needed to maintain the electrolyte 20 of the process cell 10 at an operable tin concentration with tin from the anolyte compartment 30 of the secondary cell 12. The costs incurred in operating the secondary cell 12 are predominantly those associated with the rectifier connected to the electrodes 22, 24 of the secondary cell 12 and the energy cost of the pump 36 circulating the electrolyte between the process cell 10 and the hydraulically connected secondary cell 12. There is also a relatively small cost for recycling the tin deposited on the cathode 24 of the secondary cell 12.

A further advantage of the present electroplating process is that the concentrations of tin and acid in the anolyte compartment 30 and the catholyte compartment 32 are controllable by adjusting the current output of the rectifier 26 connected to the electrodes 22, 24 of the secondary cell 12. To maintain the tin and acid concentrations at a desired level, rectifier 26 is adjusted to provide a current output equal to the sum of the current output of the process rectifier 18 and the amperes required to deposit the small amount of tin plated on the cathode 24 of the secondary cell 12. To increase the tin concentration and reduce the acid concentration, this current is raised, and to decrease the tin concentration and increase the acid concentration, this current is lowered.

Accordingly, it is an important aspect of the present invention that the anolyte compartment of the secondary cell 12 is hydraulically connected to the process cell 10 in order to bring the tin enriched solution from the anolyte compartment 30 to the process cell 10 and return the tin depleted solution back to the anolyte compartment 30. The catholyte compartment 32 of the secondary cell 12 is isolated by the perm-selective ion exchange membrane 28 and contains water and methane sulfonic acid. Water is periodically added to make up for the water dissociated at the cathode 24.

A further embodiment of the present invention includes a controller 40 which senses the output current of the process cell rectifier 18, and then delivers to the secondary rectifier 26 an amount of current expressed as a percentage of the process cell rectified current. This percentage is selected so that the tin and acid concentrations in the electrolyte of the process cell 10 are maintained at a desired concentration, regardless of variations in current output from the process rectifier 18. The controller 40 regulates the process rectifier 18 output based on the area of the cathode workpiece 16 to be plated and the desired current density.

According to another embodiment of the present invention, the plating process is useful with soluble tin anode systems when the anode current efficiency in the process cell is less than the cathode current efficiency. This would have an economic advantage in terms of making up for depleted tin in the process cell. In this case, the secondary rectifier amperage is set to a value chosen to compensate for the difference between the anode current efficiency and the cathode current efficiency in the process cell, and the amount of current requirement to plate any tin on the secondary cell, i.e., about 10% due to the permeability of the ion exchange membrane 28. It should be pointed out that the anode current efficiency in the process cell with the insoluble anode is zero with respect to tin.

It is appreciated that various modifications to the present inventive concepts described herein may be apparent to those of ordinary skill in the art without departing from the spirit and scope of the present invention as defined by the herein appended claims.

What is claimed is:

1. An apparatus for plating tin onto a workpiece, the apparatus comprising:

a) a process cell including a process anode and a workpiece cathode electrically connected to each other by a process rectifier and a process electrolyte, wherein the process electrolyte includes at least one salt of a platable tin;

b) a secondary cell including a secondary soluble anode of the platable metal and a secondary cathode electrically connected to each other by a secondary rectifier and a secondary electrolyte;

c) a permeability-selective ion exchange membrane dividing the secondary cell into an anolyte compartment containing the secondary soluble anode and a catholyte compartment containing the secondary cathode;

d) a first conduit in fluid flow communication from the anolyte compartment to the process cell;

e) a second conduit in fluid flow communication from the process cell to the anolyte compartment; and f) a controller connected between the process rectifier and the secondary rectifier.

2. The apparatus of claim 1 wherein the process anode is an insoluble anode selected from the group consisting of titanium coated with iridium oxide, titanium coated with ruthenium oxide and platinum plated titanium, and mixtures thereof.

3. The apparatus of claim 1 wherein the secondary cathode is selected from the group consisting of tin, titanium, stainless steel, copper, copper alloys, steel, ferrous alloys and nickel alloys.

4. The apparatus of claim 1 wherein the permeability-selective ion exchange membrane is of the cationic or anionic type.

5. The apparatus of claim 1 wherein the process electrolyte includes a soluble salt selected from the group consisting of tin methane sulfonic acid, tin fluoroborate and tin sulfate, and mixtures thereof.

6. The apparatus of claim 1 wherein the process anode is of titanium coated with either iridium oxide or ruthenium oxide and the secondary rectifier is set to a current chosen to compensate for the difference between the anode current efficiency and the cathode current efficiency in the process cell, and the current required to plate tin on the secondary cathode.

7. An apparatus for plating tin into a workpiece, the apparatus comprising:

a) a process cell including a process anode and a workpiece cathode electrically connected to each other by a process rectifier and a process electrolyte, wherein the process electrolyte includes at least one salt of a platable tin, and wherein the process anode is of titanium coated with ruthenium oxide;

b) a secondary cell including a secondary soluble anode of the platable metal and a secondary cathode electrically connected to each other by a secondary rectifier and a secondary electrolyte;

c) a permeability-selective ion exchange membrane dividing the secondary cell into an anolyte compartment containing the secondary soluble anode and a catholyte compartment containing the secondary cathode;

d) a first conduit in fluid flow communication from the anolyte compartment to the process cell; and e) a second conduit in fluid flow communication from the process cell to the anolyte compartment.

8. The apparatus of claim 7 further including a controller connected between the process rectifier and the secondary rectifier.

9. A method for plating tin onto a workpiece, comprising the steps of:

a) providing an apparatus comprising:

i) a process cell including a process anode and a workpiece cathode electrically connected to each other by a process rectifier and a process electrolyte, wherein the process electrolyte includes at least one platable salt of tin;

ii) a secondary cell including a secondary soluble anode of the platable metal and a secondary cathode electrically connected to each other by a secondary rectifier and a secondary electrolyte;

iii) a permeability-selective ion exchange membrane dividing the secondary cell into an anolyte compartment containing the secondary soluble anode and a catholyte compartment containing the secondary cathode;

iv) a first conduit in fluid flow communication from the anolyte compartment to the process cell; and v) a second conduit in fluid flow communication from the process cell to the anolyte compartment;

b) operating the process cell by passing a first current controlled by the process rectifier from the process anode to the workpiece to thereby plate the platable tin on the workpiece;

c) operating the secondary cell by passing a second current controlled by the secondary rectifier from the secondary soluble anode to the secondary cathode to thereby provide a tin enriched anolyte in the anolyte compartment of the secondary cell;

d) moving the tin enriched anolyte from the secondary cell to the process cell through the first conduit as the process cell is being operated;

e) removing electrolyte from the process cell to the secondary cell through the second conduit; and f) a controller connected between the process rectifier and the secondary rectifier.

10. The method of claim 9 including providing the process anode selected from the group consisting of titanium coated with iridium oxide, titanium coated with ruthenium oxide and platinum coated titanium, and mixtures thereof.

11. The method of claim 9 wherein the secondary cathode is selected from the group consisting of tin, titanium, stainless steel, copper, copper alloys, steel, ferrous alloys and nickel alloys.

12. The method of claim 9 wherein the permeability-selective ion exchange membrane is of the cationic or anionic type.

13. The method of claim 9 wherein the process electrolyte includes a soluble salt selected from the group consisting of tin methane sulfonic acid, tin fluoroborate and tin sulfate, and mixtures thereof.

14. The method of claim 9 including providing the process anode of tin and setting the secondary rectifier at a current to compensate for the difference between the anode current efficiency and the cathode current efficiency in the process cell, and the amount of current required to plate tin on the secondary cathode.

15. A method for plating tin onto a workpiece, comprising the steps of:

a) providing an apparatus comprising:

i) a process cell including a process anode of tin and a workpiece cathode electrically connected to each other by a process rectifier and a process electrolyte, wherein the process electrolyte includes at least one platable salt of tin;

ii) a secondary cell including a secondary soluble anode of the platable metal and a secondary cathode electrically connected to each other by a secondary rectifier and a secondary electrolyte;

iii) a permeability-selective ion exchange membrane dividing the secondary cell into an anolyte compartment containing the secondary soluble anode and a catholyte compartment containing the secondary cathode;

iv) a first conduit in fluid flow communication from the anolyte compartment to the process cell; and v) a second conduit in fluid flow communication from the process cell to the anolyte compartment;

b) operating the process cell by passing a first current controlled by the process rectifier from the process anode to the workpiece to thereby plate the platable tin on the workpiece;

c) operating the secondary cell by passing a second current controlled by the secondary rectifier from the secondary soluble anode to the secondary cathode to thereby provide a tin enriched anolyte in the anolyte compartment of the secondary cell, wherein the second current compensates for the difference between the anode current efficiency and the cathode current efficiency in the process cell, and the amount of current required to plate tin on the secondary cathode;

d) moving the tin enriched anolyte from the secondary cell to the process cell through the first conduit as the process cell is being operated; and e) removing electrolyte from the process cell to the secondary cell through the secondary conduit.

16. The method of claim 15 including providing a controller connected between the process rectifier and the secondary rectifier.

* * * * *